US007936286B2

(12) United States Patent
Adair

(10) Patent No.: US 7,936,286 B2
(45) Date of Patent: May 3, 2011

(54) EMERGENCY INFORMATION AND TRANSPORTATION CONTROL SYSTEM

(76) Inventor: Robin Adair, Tampa, FL (US)

( * ) Notice: Subject to any disclaimer, the term of this patent is extended or adjusted under 35 U.S.C. 154(b) by 244 days.

(21) Appl. No.: 12/148,730

(22) Filed: Apr. 21, 2008

(65) Prior Publication Data

US 2009/0261972 A1 Oct. 22, 2009

(51) Int. Cl.
*G08G 1/123* (2006.01)

(52) U.S. Cl. ..... 340/995.12; 340/995.14; 340/905

(58) Field of Classification Search ..... 340/905, 340/906, 907, 944, 995.1, 995.12, 995.13, 340/995.24, 995.27, 988, 995.14; 701/117, 701/201; 455/404.1, 456.3, 456.2
See application file for complete search history.

(56) References Cited

U.S. PATENT DOCUMENTS

| | | | | |
|---|---|---|---|---|
| 6,580,904 | B2 * | 6/2003 | Cox et al. | 455/456.2 |
| 6,816,727 | B2 * | 11/2004 | Cox et al. | 455/414.1 |
| 7,349,768 | B2 * | 3/2008 | Bruce et al. | 701/1 |
| 7,395,151 | B2 * | 7/2008 | O'Neill et al. | 701/209 |
| 7,454,442 | B2 * | 11/2008 | Cobleigh et al. | 707/104.1 |
| 7,650,231 | B2 * | 1/2010 | Gadler | 701/201 |
| 2007/0208864 | A1 * | 9/2007 | Flynn et al. | 709/227 |

* cited by examiner

*Primary Examiner* — Van T. Trieu

(57) ABSTRACT

A system for providing transportation information to passengers during an emergency, such as a terrorist attack. The system links emergency responders, public transportation operations (including subways, buses and other mass transit systems), and network operations in a coordinated evacuation of a crowded metropolitan area. Information is provided to the public via system of networked kiosks and displays provided strategically throughout a city. In another embodiment of the present invention, the system provides transportation and routing information to passengers during a non-emergency.

14 Claims, 1 Drawing Sheet

EMERGENCY INFORMATION AND TRANSPORTATION CONTROL SYSTEM

BACKGROUND

1. Technical Field

The present invention relates to information management systems.

2. Background Information

As the United States learned on Sep. 11, 2001, quickly disseminating information to every level of government is essential to an effective government response during a crisis. However, saving the lives of those in proximity to the crisis can depend on the degree to which the municipal area surrounding the crisis is informed of the location of the epicenter of the crisis and the most efficient paths away from the center of the crisis. As some types of crises unfolds, the need to inform takes on a dynamic characteristic. For instance, the process of directing and shuttling members of the public away from the crisis center, is not one of simply filling all available buses and trains and moving people to safety. Complications arise when the role of rescue and other crisis personnel is considered. The ensuing rush of pedestrians away from the scene can block the access of firefighters, law enforcement officials, rescue workers and other personnel who need immediate access to the scene. Furthermore, personnel who are rushing to the scene must be informed of the crisis details in order to respond appropriately. A crisis in which the danger to the public persists or grows greater with the passage of time, such as a terrorist attack which takes place in stages over multiple metropolitan areas or a fire having the potential to spread from building to building in a crowded metropolitan area, merits a high level of urgency and a high level of population displacement. Crises which are easily circumscribed, such as a shooting in which the perpetrator is incapacitated immediately, or a disabled subway train, require a lower level of urgency and a correspondingly lower level of population displacement. Furthermore, the most efficient path of egress is dependent upon the location of an individual with respect to the crisis location, whether it be a subway stop or a bus stop; a stop downtown or a stop uptown. Moreover, as a crisis unfolds and egress begins, the optimal path of egress may change as routes which were clear at the beginning of the crisis become saturated with egressors.

Unambiguously informing the public and government/municipality entities of crisis details increases the ability of public transportation and thoroughfares to assist in the efficient evacuation of a municipal area. It stands to reason that a crisis response which directs members of the public with respect to the most efficient path of egress, whether by foot or public transportation, and which communicates to the public egress instructions with respect to maximum efficiency and existing public transportation resources will save many lives in the event of a disaster. Furthermore, a system which additionally has the capacity to update the instructions given to pedestrians and others at a given location such that the egress is can be choreographed, will reduce loss of life to an even greater degree.

To date, there is an urgent need for a system that provides for rapid, seamless information dissemination and management among multiple levels of government and agencies, as well as to the public. Moreover, there is a need for a system that provides street or mass transit level information to the public.

BRIEF SUMMARY

The present invention provides a system of kiosks, located in and around subway stops, bus stops, high rail platforms, and/or other loci of public transportation, having the ability to updatably inform the public of crises, as well as other non-crisis events such as concerts, festivals, etc., and direct the public with respect to the path of transportation which will most efficiently transport them to a safe zone, in the event of a crisis, or to their desired destination for other non-crisis events. The present invention also has the capability of informing the public in non-crisis times of routine travel information such as scheduled departures and arrivals, as well as optimum routes to given locations. In one embodiment, the present invention has an interactive function and can provide a member of the public with an optimum public transportation route to a desired location.

DETAILED DESCRIPTION OF THE DRAWINGS AND PREFERRED EMBODIMENTS

Figure 1:
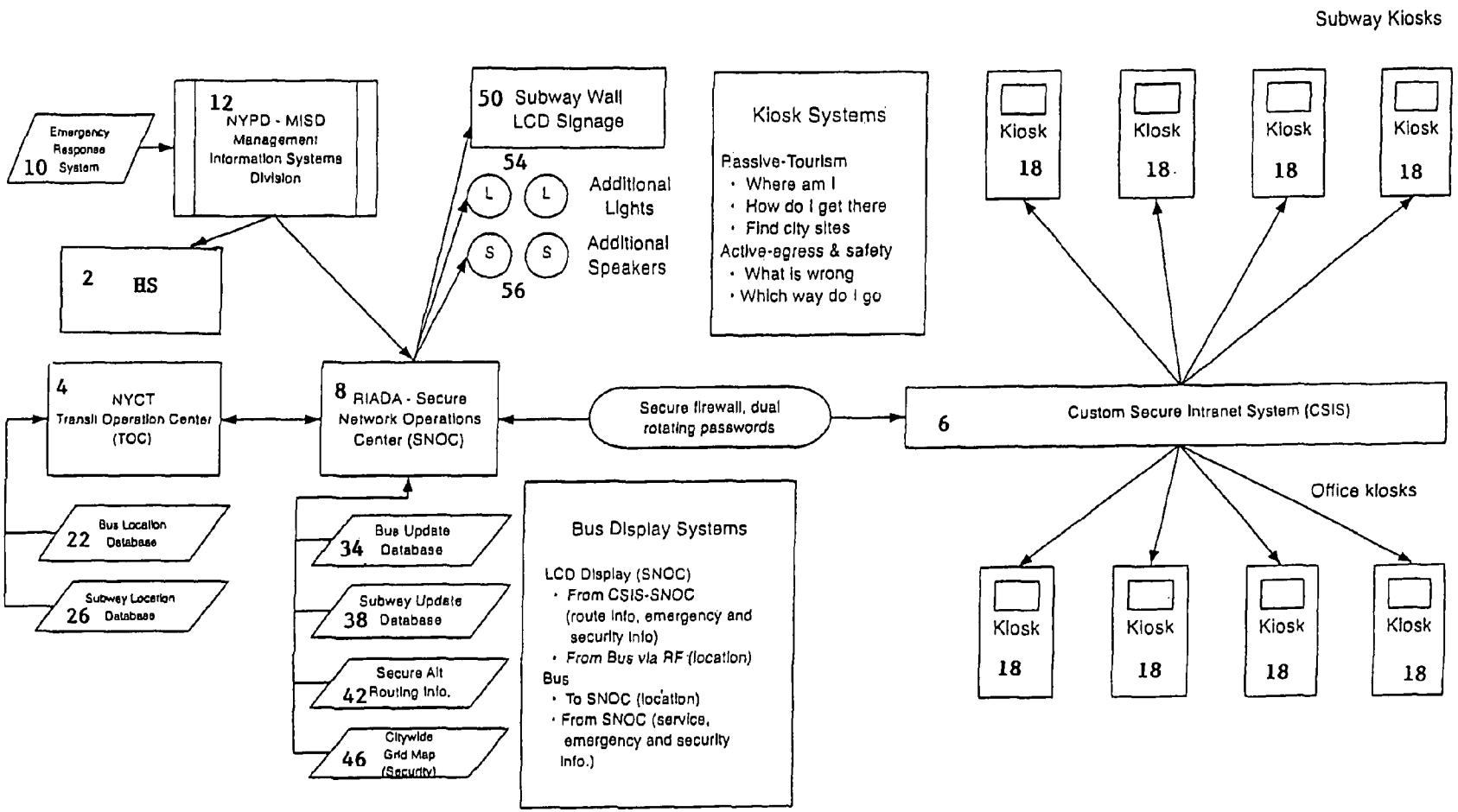
FIG. 1 is a flow diagram of one embodiment of the present invention.

The "optimum path of egress" is the egress plan by which people at a given location can travel to a safe location in the most efficient manner. By "most efficient," it is meant that the travel takes the person to the closest available zone of safety or desired location in the safest manner or in the least amount of time.

Note that the zone of safety is dependent upon the location of the crisis, and as the crisis evolves, the zones of safety may change. For instance, as a fire spreads and becomes close to a flammable storage facility, it may be necessary to re-evaluate the zone of safety locations. A given zone of safety can become overcrowded with displaced egressors and unable to accommodate additional volume.

The optimum path of egress may be composed of more than one leg, such as one or more subway legs interspersed with one or more bus and/or pedestrian legs. Furthermore, it may change as the crisis evolves. For instance, the optimum path of egress can change because the zones of safety may change with crisis evolution for the reasons given above. It should be noted that the invention actually manages the efflux of a large number people away from the crisis area. Thus at any given time, in one embodiment, an optimum path of egress for any given locus of public transportation will take into account overall features of the evolving crisis, and the plan given can be one in which is most efficient and/or safe, on a person average, in relocating the public to zones of safety. Thus, those members of the public who are in the most danger may be given the most direct route away from the crisis, while those who are at reduced risk may be given a route which is less direct and which does not involve the use of public transportation resources committed to those in the greatest and most immediate danger.

Please see FIG. 1. The optimum path of egress is determined by the Secure Network Operations Center (SNOC) 8. In a preferred embodiment, the SNOC 8 includes a database of predetermined optimum paths of egress (one optimum path of egress for each kiosk location) for a given set of crisis conditions and locations. The crisis conditions include crisis location, and can include public transportation ridership patterns, unit (a bus, a train, or other vehicle for public transportation) locations for the time of day at which the crisis is occurring; public transportation units and lines which are made nonoperational by the crisis, etc. The SNOC 8 matches the Optimum Paths of Egress stored in a database with the crisis conditions present at the time. The SNOC 8 obtains the crisis conditions from the bus, subway and other public transportation update databases, discussed below. In one embodiment, the SNOC 8 also receives update information from the kiosks which are located at public transportation loci. In this embodiment, each kiosk can collect information about the conditions at its locus, such as population density, deviations from schedule, etc, and transmit it back to the SNOC 8 through the Custom Secure Intranet System, either through input by an operator or some other means. In other embodiments, the optimum path of egress is calculated based upon the bus and subway inputs to the SNOC 8 and the databases such as schedules and ridership patterns, to which the SNOC 8 has direct or indirect access, as discussed below.

The SNOC 8 can receive real time crisis information which is updated at intervals or is continuously updated. In specific embodiments, the information and updates can be with respect to one or more of the following: crisis location, degree of potential for spreading to other specific populated locations, population patterns and densities as a function of time and place, bus, subway and train scheduled locations, as well as updated real time information with respect to the foregoing parameters as the crisis evolves. This information can come from any of a variety of sources. However, in preferred embodiments, the crisis update information comes from MISD, Homeland Security, the kiosks or the update databases. From the crisis update information and the update and other databases to which it has access, the SNOC calculates and/or identifies optimum path of egress updates or changes and transmits the updated information to the kiosks through the CSIS. The kiosks register the update and display the updated information.

The SNOC 8 is in two-way communication with the Custom Secure Intranet System (CSIS) 6, and in a preferred embodiment, a firewall exists between them and access is subject to dual rotating passwords. The Custom Secure Intranet system (CSIS) 6 receives information from the SNOC 8, including updates to the realtime databases such as the Bus Location Database and the Subway location database. The CSIS 6 coordinates the dissemination of information to, and in some embodiments, the receipt of information from, the kiosks at the public transportation loci.

While the SNOC 8 and the CSIS 6 can be proximally located with respect to each other, or even in the same location, locating them some distance from each other minimizes the chance that they will both be disabled by the same event, and enables the use of an effective strategy of redundant communication lines between them. In one embodiment, communications between the SNOC 8 and the CSIS 6 are transmitted over redundant communication lines. In further embodiments the redundant communication lines comprise one or both of wire and fiber optic. It is preferable that the redundant lines are in separate conduits which are spaced apart in order that in the event of disruption of a primary line or a secondary line, such as by a blown transformer or a terrorist attack, the likelihood of complete disruption of communication is reduced. In the above embodiments, the system has the ability to switch communications to the undamaged line.

The above strategy of redundant communication also extends to the communication lines between the SNOC 8 and the individual kiosks. In a preferred embodiment, these lines reach the kiosks via the CSIS 6. Communication to the kiosks and other displays are essential to travel and emergency actions in that the kiosks and displays are the primary means of informing the public. The lines to the kiosks are subject to disruption by lightning, flood, fire, vandalism and sabotage. In one embodiment, the lines are fiberoptic.

In one embodiment, the switching between primary and redundant lines occurs as follows. In the case that the CSIS 6 receives no response from the kiosk over the primary line after a given number of tries, it begins to switch between primary and redundant lines at a given rate. If a kiosk has not received a signal from the CSIS 6 after a given number of tries, it also begins to switch between lines at a different rate. Because the CSIS 6 and kiosk are switching at different rates, they will eventually "see" each other. Once the entire signal is received, the CSIS 6 and kiosk will establish communication via lines which are operational.

The kiosks are connected to the CSIS 6, and in one embodiment, communication between the kiosks and the CSIS 6 requires the use of rotating passwords. In one embodiment, the communication connection to the kiosks is fiber and/or copper at speeds in the range of from about 1.25 to 3.25 Mbps. In another embodiment, the speed is in the range of from about 1.5 to about 3.0 Mbps. In yet another embodiment, the updates to the kiosk information is provided in a background mode. The updates can be easily performed during operating hours without interrupting the kiosk interactive function. In another embodiment, alerts can be sent as short binary words, reducing the need for bandwidth.

In other embodiments, some or all of the communications between the SNOC 8 and the CSIS 6 and the kiosks are encrypted, with any or all information and responses from the kiosk encrypted as well. In such a case, the associated personnel would have access to the codes and encryptions.

In order to best respond to any transportation or emergency situation, the kiosks must be able to receive all information from the SNOC 8, the City Command Center and, in an embodiment Homeland Security (HC) 2. The information can be acquired from a single feed, such as from the CSIS 6, or a separate feed from each of the three. In a preferred embodiment, all communications from each of the three agencies are communicated to the CSIS 6. From the CSIS 6, the appropriate information is sent to the appropriate kiosk. In one embodiment, the kiosks additionally receive information which is sent to subway LCD displays 50 and speakers 56. Thus the kiosks, displays and speakers can operate in a coordinated and uncontradictory manner and sequence.

The Transit Operation Center (TOC) 4 functionality accesses information from static sources, including, but not limited to a city grid map; databases containing route information (including but not limited to stations, expected arrival and departure times), information pertaining to the type of transport (including but not limited to bus, train, subway, carrying capacity), and information relating to both (including but not limited to safe speeds and maximum speeds at particular locations). In one embodiment, the TOC 4 can access information from one or more of the following: a subway location database, a bus location database, and a citywide grid map.

The TOC 4 has the ability to receive updated information from the SNOC 8. The TOC 4 receives real-time information in the form of updates to some or all of its information parameters through the SNOC 8. Updates include updates to bus, subway and other transportation mode parameters such as position, operating routes, carrying capacities, location of carrier, operational stations and stops, etc. Thus, in the event of a crisis, the intercommunication between the TOC 4, Homeland Security (HS) 2 and the SNOC 8 ensures that HS 2 receives up-to-date information about a crisis and its evolving impact on the municipal transportation system, even if the crisis effects a severance between any two of the three elements. For instance, severed communication between HS 2 and the SNOC 8 or between HS 2 and the TOC 4 does not prevent the HS 2 from acquiring updated transit information, and in general, the system will function as long as one of the three can act as a bridging functionality. as well as having a redundant line of access to evolving n independent source of transit update information, in the event that the crisis effects a severance of communication between the TOC 4 and the SNOC 8, or between HS 2 and either the TOC 4 or the SNOC 8.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings. It should also be understood that the drawings are not to scale and in certain instances details have been omitted, which are not necessary for an understanding of the present invention, such as conventional details of fabrication and assembly.

As illustrated in FIG. 1, in one embodiment of the present invention, a system 10 is disclosed for providing transportation information to passengers during an emergency, such as a terrorist attack. The system 10 links the Department of Homeland Security 2, transit operations centers 4 (including subways, buses and other mass transit systems), and network operations centers 8. Information is provided to the public via a custom secure intranet system 6, which is linked to networked kiosks 18 provided strategically throughout a city. During non-crisis periods, the system 10 can be used alternatively to provide transportation information to passengers.

As illustrated in FIG. 1, the transit operation center 4 is networked and in communication with a bus location database 22, a subway location database 26, and, optionally databases associated with other modes of transportation, such as light rail. The location databases 22 and 26 are configured to provide real-time information regarding the locations of buses and subways, respectively. The information includes parameters, examples of which can include the number of units (bus, train, etc.) running, identification of the particular unit, route maps, stop locations, expected or estimated arrival times, even expected or estimated speeds along specific portions of a given route. This information is relayed to the Department of Homeland Security 2, the network operations center 8, and the custom secure intranet system 6, which in turn, disseminates the information of relevance to the public to the public kiosks 18 and in some embodiments, to displays 50.

As illustrated in FIG. 1, information regarding buses, subways and/or other modes of public transportation is updated by bus update database 34 subway update database 38, respectively, and optionally other update databases such as a light rail update database. Additional databases such as a citywide grid map 46, can be at the disposal of the SNOC 8 as well.

The update databases are in communication with the SNOC 8 which can send the updates to responder bureaus such as the municipal Police Department and/or Fire Department Management Information Systems Division (MISD) 12 or the equivalent, or another municipal bureau which organizes the municipal response team comprising law enforcement, rescue, fire or other personnel 10 and 12.

The link between the SNOC 8 and the MISD 12 enables the details of an event to be transmitted to the SNOC 8. The SNOC 8 determines the optimum route plan and disseminates it to the kiosks via the CSIS 6. The CSIS 6 is insulated from the SNOC 8 with a secure firewall and dual rotating passwords.

The SNOC 8 disseminates the collected bus data and subway update data information through the CSIS 6, to the kiosks 18, and optionally, and in one embodiment street displays, which update their readouts. Additional alternative routing information 42 can also be provided to the SNOC 8. In one embodiment, the alternative routing information is a database which contains the preset alternative routing plans for bus, subway and/or other means of public transportation in the event of a given, hypothetical emergency or other event. Thus, in the event of a crisis or other non-crisis event, the alternative routing information database 42 provides preplanned egress information which corresponds to the given emergency or non-emergency event. In another embodiment, the SNOC 8 can access a citywide grid map which can be as detailed as the application requires. For instance the map can indicate routes or route legs of secondary and tertiary importance which can be called into service in an emergency or non-emergency event. The grid map can be used to ensure, among other things, that the alternate routes still exist, are in adequate repair to receive traffic, or have not been closed off or otherwise disabled.

In yet another embodiment, the optimum egress plan is calculated by the SNOC 8 using either 1) the Transit Operation Center (TOC) 4, update databases, and optionally, the alternate routing information and/or the city wide grid map, or 2) updated information from the TOC 4.

The SNOC 8 is also in communication with the TOC 4 which receives the updates as they are collected. In one embodiment, the updates are used by the TOC 4 to update its own real time transportation information, and the updated transportation information is sent back to the SNOC 8.

In some embodiments of the present invention, the SNOC 8 or the CSIS 6 have the capability of directly deploying lights 54 and/or speakers 56 which can serve an alarm function, such as rhythmic flashing and sirens. Alternatively, the lights and speakers can be used to illuminate and to broadcast an appropriate message, prerecorded or live. In additional embodiments, the SNOC 8 or the CSIS 6 have the capability of deploying subway wall signage 50.

Information that is disseminated to the public via kiosks 18 or displays 50 can include active egress and safety information. This includes situational reports and directional information regarding safe egress routes for the public. During non-crisis periods, the kiosks 18 can also provide information regarding a person's location, and directions from one point to another.

In an alternative embodiment, active egress and safety information can be provided in a portable unit that can be strategically situated. This portable unit can also provide information to first responders or government officials regarding a location status.

It is therefore intended that the foregoing detailed description be regarded as illustrative rather than limiting, and that it be understood that it is the following claims, including all equivalents, that are intended to define the spirit and scope of this invention.

The invention claimed is:

1. A system for directing pedestrian and public transportation traffic, said system comprising:

a) an input comprising a crisis, including its public transportation specific effects;

b) one or more databases comprising:

1) a map of public transportation-accessible thoroughfares;

2) public transportation location databases; and 3) public transportation location update databases;

4) optionally, optimum path database as a function of transportation specific effect of crisis;

5) optionally, a secure alternate routing information database;

c) two or more kiosks, each having a location, and each having the capacity to:

1) display an optimum route of egress, said route of egress corresponding to the location of the kiosk;

2) display an updated optimum path of egress upon receiving updates of the input in a) and/or b)2) and b)3);

d) a function having the capacity to i) identify, for each portal and location in c), the corresponding member of 4) which best corresponds to the crisis and specific effects in a) or ii) calculate, from one or more of 1), 2) and 3), location dependent optimum paths of egress for each kiosk and location in c).

2. A system as in claim 1 wherein the thoroughfares in b (1) are public transportation accessible.

3. A system as in claim 2 wherein the location databases comprise at least one of at least two bus locations, at least two subway locations, and at least two light rail locations.

4. A system as in claim 1 wherein the location databases contain scheduled locations of the transportation units as a function of time, and optionally, estimated ridership as a function of time and transportation unit.

5. A system as in claim 1 wherein the transportation location databases comprise at least one bus location database and at least one subway location database.

6. A system as in claim 5 wherein the transportation location update databases comprise at least one bus location update database and at least one subway location update database.

7. A system as in claim 6 wherein the transportation location update databases comprise at least one bus location update database and at least one subway location update database; wherein the location databases are accessible by a Transit Operations Center and wherein the update databases are accessible by a Network Operations Center.

8. A system as in claim 7, wherein the Secure Network Operations Center is in communication with the Transit Operation Center.

9. A system as in claim 7 wherein a Custom Secure Intranet System is in communication with the Secure Network Operations Center and with the kiosks in c; and wherein it receives location dependent optimum path update information for one or more kiosks in c).

10. A system as in claim 9 wherein the kiosks in c) are located at subway stations.

11. A system as in claim 1 wherein the location databases are accessible by a Transit Operations Center.

12. A system as in claim 1 wherein the update databases are accessible by a Secure Network Operations Center.

13. A system as in claim 12 wherein the location databases comprise at least one of at least two bus location updates, at least two subway location updates, and at least two light rail location updates.

14. A system as in claim 1 wherein the transportation location update databases comprise at least one bus location update database and at least one subway location update database.

* * * * *